United States Patent [19]

Kramm et al.

[11] 4,131,418

[45] Dec. 26, 1978

[54] TUBE COOLERS FOR ROTARY KILNS

[75] Inventors: Douglass J. Kramm, Allentown; Thomas R. Lawall, Emmaus; Paul Talago, Center Valley, all of Pa.

[73] Assignee: Fuller Company, Catasauqua, Pa.

[21] Appl. No.: 799,885

[22] Filed: May 23, 1977

[51] Int. Cl.[2] ..... F27D 15/00

[52] U.S. Cl. ..... 432/80; 432/84; 432/106

[58] Field of Search ..... 432/80, 83, 84, 106

[56] References Cited

U.S. PATENT DOCUMENTS

| | | | |
|---|---|---|---|
| 1,582,831 | 4/1926 | Lanhoffer | 432/80 |
| 2,971,751 | 2/1961 | Andersen | 432/80 |
| 3,809,528 | 5/1974 | Kramm | 432/80 |
| 3,840,334 | 10/1974 | Chielens | 432/106 |

*Primary Examiner*—John J. Camby

*Attorney, Agent, or Firm*—Frank H. Thomson

[57] ABSTRACT

An attached tube cooler for a rotary kiln for cooling solid particulate material discharged from the kiln. The cooler includes a plurality of cylindrical vessels attached to and circumferentially spaced around the discharge end of the kiln for rotation therewith. Each cooler tube has an inlet for solid particulate material communicating with the outlet of the kiln, an outlet for cooled solid particulate material, an inlet for cooling gas and an outlet for gas which communicates with the kiln so that gas heated in the cooler tube can be supplied as combustion air to the kiln. Heat exchange fins are mounted inside the cooling tube at an angle such that the trailing surface of the fins in the direction of tube rotation forms an acute angle with the side wall of the cooler tube. A helical conveyor having a central opening therethrough advances material through the cooler tube.

13 Claims, 5 Drawing Figures

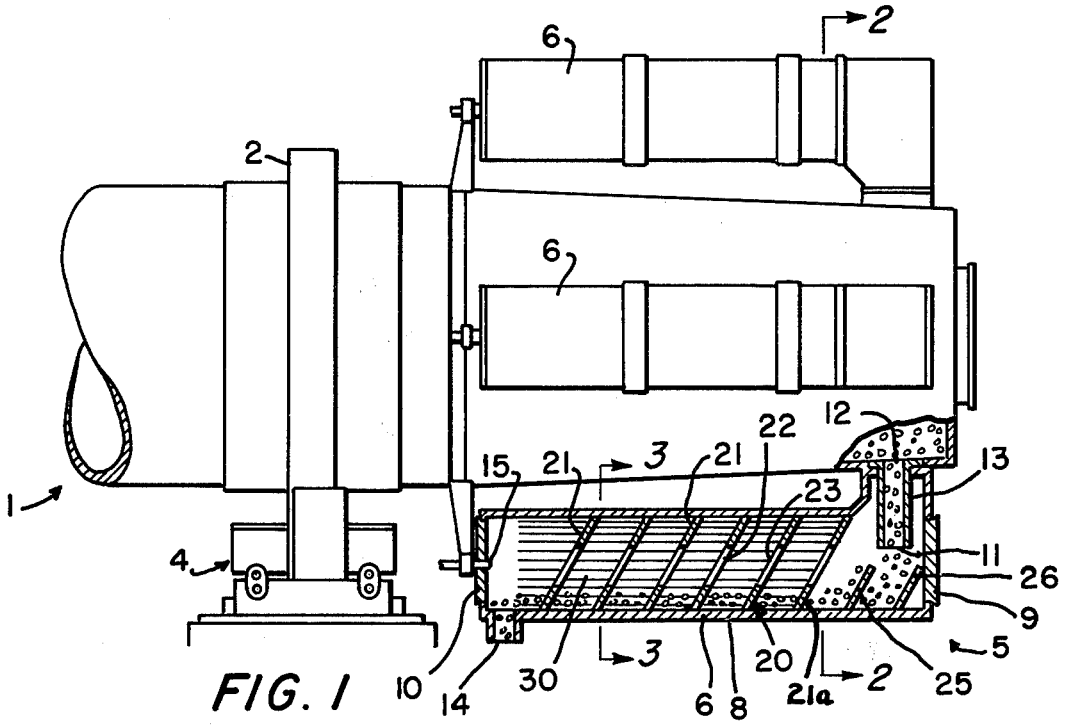
FIG. 1
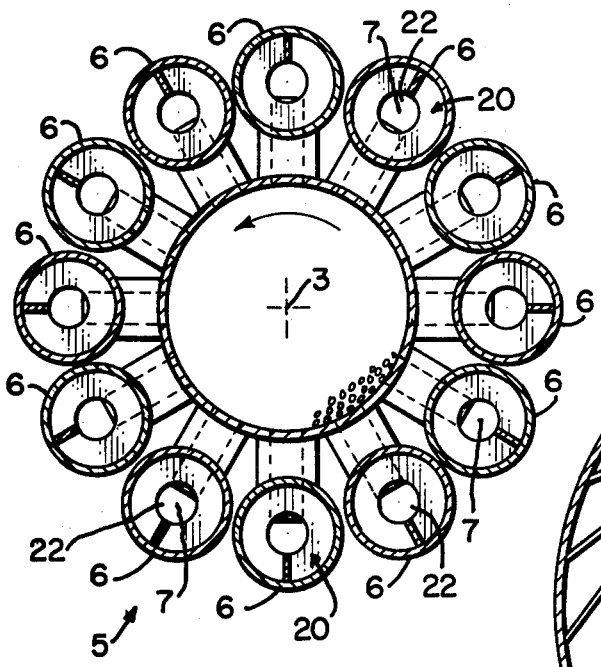
FIG. 2
FIG. 3
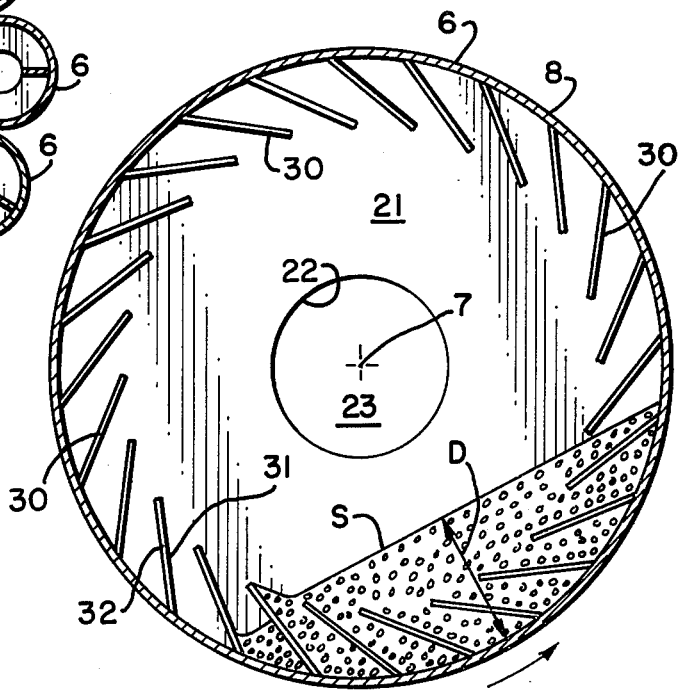

TUBE COOLERS FOR ROTARY KILNS

BACKGROUND OF THE INVENTION

The present invention relates to rotary heat exchangers and more particularly to an improved attached tube cooler for cooling hot solid particulate material which has been thermally processed in a rotary kiln.

Attached tube coolers, sometimes referred to as planetary or satellite coolers, used in conjunction with rotary kilns for cooling hot particulate material discharged from the rotary kiln have been in use for many years. An attached tube cooler will include a plurality of circumferentially spaced apart cylindrical cooler tubes which are attached to the discharge end of a rotary kiln. Each cooler tube is mounted on the kiln so that its longitudinal axis is parallel to and and offset from the longitudinal axis of the kiln. The tubes may be mounted on the kiln so that the cooler discharge is downhill from the cooler inlet and kiln discharge so that material moves through the cooler by gravity as it tumbles within the cooler tube, or the tubes may be mounted so that the cooler discharge is uphill from the cooler inlet and kiln discharge. In the later instance, a helical conveyor is provided in the cooler tubes to advance material through the cooler as the material tumbles within the cooler tube during the cooler's rotation. The present invention is applicable to both types of installations, but the description will be directed to a cooler with an uphill cooler outlet.

Attached tube coolers operate on the principal of being attached to the discharge end of a rotary kiln for rotation with the kiln and for receiving at one end hot particulate material directly from the kiln outlet. Cooling gas such as ambient air is supplied to the other end of the cooler tube for countercurrent heat exchange contact with the hot material to thereby cool the hot material. As the material is cooled, the cooling gas is heated and returned to the kiln as preheated combustion air. As the cooler tubes rotate with the kiln about the longitudinal axis of the kiln, the material is tumbled within the cooler tube to achieve greater contact with the gas flowing through the cooler tube as well as advance the material from the inlet to the outlet.

Prior to the present invention, it was common practice to employ within rotary heat exchange apparatus various devices such as chains to improve the heat exchange contact between gas and solid.

Also prior to the present invention, it was common practice to employ lifters within the cooler tube in an effort to improve the contact between the particulate material and the cooling air. These lifters are creatively designed to pick up material from the bottom of the cooler tube. The material picked up by the lifters will fall from the lifters as the cooler moves through its rotational path about the axis of the kiln to thereby create a curtain of material within the cooler tube which is directly exposed to the gas flowing through the cooler tube. Typical examples of such apparatus are shown in U.S. Pat. Nos. 3,830,623 and 2,845,259.

Although the use of such lifters to produce a curtain of material within the cooler tube may create better contact between the cooling gas and the solid to be cooled, so much contact between the gas and the solid is created that a large quantity of the solid material will be entrained in the gas stream and returned to the kiln with the heated gas. This material which has been returned to the kiln must then be recycled back to the cooler thereby reducing the efficiency of the cooling apparatus as well as the kiln operation. This is particularly a problem when fine material such as alumina is being processed. It would, therefore, be desirable to reduce the amount of air-borne particles within the cooler tubes.

It has been found that efficient heat exchange can be achieved by increasing the surface area of metal exposed to the hot material so that the heat of the material is transferred to the shell of the cooler tube by conduction to thereby improve cooling of the material. More important, air flow through the cooler tube is used not only for cooling the material by direct contact between the air and material, but also to cool the metal which has been exposed to the hot material during a portion of the cooler's travel around the kiln axis, but the material is not exposed directly to the high velocity airflow during the balance of the cooler tube's travel around the kiln axis. By the present invention, additional heat exchange surface area is added to the cooler by using heat exchange fins which are designed so that they do not lift the material to fall in a curtain through the path of air flow through the heat exchanger. In the present invention, the heat exchange fins are "swept back" in the direction of rotation.

Some rotary heat exchangers prior to the present invention employed swept back fins, but conventionally these fins covered an air plenum and served to define an air passage from the plenum to the inside of the heat exchangers and prevent material from entering the plenum. Typical examples of such devices are shown in U.S. Pat. Nos. 2,483,738 and 2,581,756. Another example of swept back fins is shown in U.S. Pat. No. 3,357,382, but this device is used in an incinerator to insure complete combustion of ash and the fins of this patent are not designed for the purpose of improving heat exchange.

With many attached tube coolers, it is necessary to provide some means for advancing the material to be cooled from the material inlet to the material outlet. Such is the case when the cooler outlet is uphill from the cooler inlet. Attached tube coolers employing helical conveyors are known prior to the present invention as illustrated by U.S. Pat. No. 3,809,528 and many others, and it was even known to combine the lifters used to improve gas-solids contact and the conveyor as illustrated in U.S. Pat No. 3,556,495. The present invention is described as employing a helical conveyor within the cooler tube.

SUMMARY

It is the principal object of this invention to provide a rotary heat exchange apparatus which has improved heat exchange characteristics.

It is a further object of this invention to provide an attached tube cooler for cooling hot solid particulate material discharged from a rotary kiln which is more efficient than prior apparatus of this type.

It is a further object of this invention to provide a cooler tube for an attached tube cooler which has improved heat exchange ability while reducing the quantity of dust returned to the kiln with the heated cooling gas.

In general, the foregoing and other objects of this invention will be carried out by providing an apparatus for cooling solid particulate material thermally treated in a rotary kiln including a plurality of elongated cylinders adapted to be mounted on a rotary kiln for rotation with said rotary kiln about the axis of the kiln, each of said cylinders having an inlet at one end for receiving hot solid particulate material discharged from said kiln; an outlet at the other end for discharging cooled solid particulate material from the cylinder; an inlet at said other end of the cylinder for supplying cooling air to the cylinder whereby the cooling air passes through the cylinder to cool the hot solid particulate material and is supplied to the kiln as preheated combustion air; an apparatus for improving the heat exchange within the cylinder comprising: a plurality of circumferentially spaced apart fins mounted within each of said cylinders at an angle to the radius such that in the direction of rotation, an acute angle is formed between the trailing surface of the fin and the cylinder wall.

BRIEF DESCRIPTION OF THE DRAWINGS

The invention will be described in connection with the annexed drawings wherein:

FIG. 1 is an elevation partly in section, of an attached tube cooler mounted on the discharge end of a rotary kiln;

FIG. 2 is a sectional view taken on the line 2—2 of FIG. 1;

FIG. 3 is a sectional view of an individual cooler tube taken on the line 3—3 of FIG. 1;

DESCRIPTION OF THE PREFERRED EMBODIMENT

Figures 4, 5:
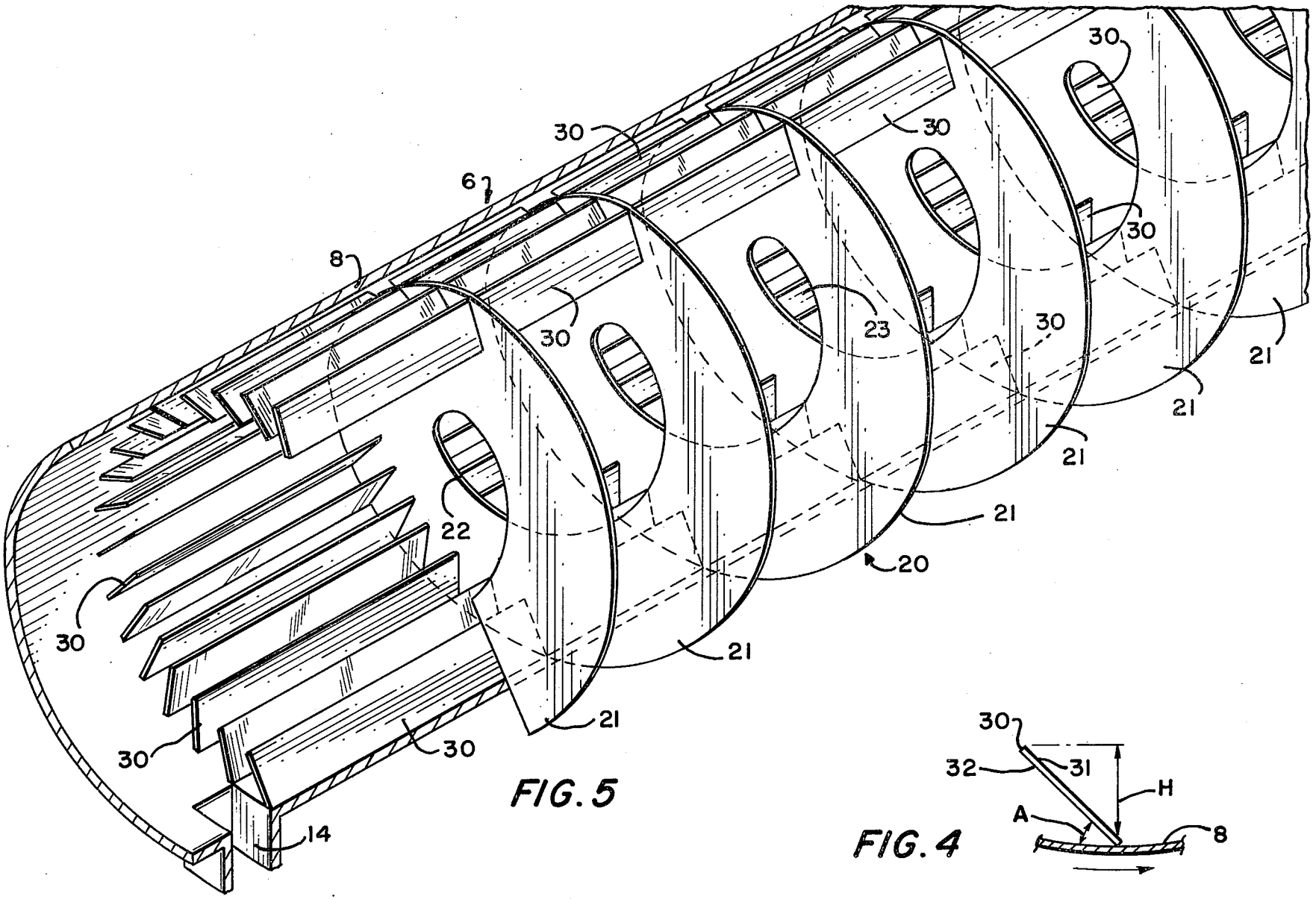
FIG. 4 is a detail of the cooler tube.
FIG. 5 is a perspective view showing the internals of an individual cooler tube.

Referring to the drawings, there is shown in FIG. 1 the discharge end of a rotary kiln 1 with the kiln including a plurality of spaced apart tires one of which is shown at 2 for mounting the kiln for rotation about its own axis 3 on a plurality of roller and bearing assemblies, one of which is shown and generally indicated at 4. A gear and pinion set (not shown) is conventionally provided for rotating the kiln. The kiln 1 rotates in the direction of the arrows in FIGS. 2 and 3. An attached tube cooler generally indicated at 5 is shown in FIG. 1, and includes a plurality of cooler tubes 6 each secured to the kiln 1 so that the axis 7 of the cooler tube is parallel with and offset from the axis 3 of the kiln 1.

Each cooler tube 6 is a tubular vessel having peripheral walls 8 and end walls 9 and 10. Each tube 6 includes an inlet 11 for receiving hot particulate material discharged from the outlet 12 of the kiln 1. The inlet 11 may be defined by a chute 13 flow connecting the outlet 12 of the kiln and the inlet 11 of the cooler tube 6.

The cooler tube 6 has an outlet 14 for cooled solid particulate material at its other end. Between the cooler inlet 11 and outlet 14, the peripheral walls 8 of the cooler are substantially solid. Also at the other end of the cooler tube 6, there is an inlet 15 for cooling gas such as ambient air. The cooler tube 6 also includes an outlet for gas which outlet may be defined by the solid particulate material inlet 11 and chute 13 for supplying the gas to the kiln for use as combustion air, or there may be a separate conduit for supplying gas from the cooler tube 6 to the kiln 1. The structure of the inlet and outlet for solid particulate material and the inlet and outlet for cooling air may be of any well known design. The position of the solid particulate material inlet and outlet and the position of the gas inlet and outlet are such that generally countercurrent contact between the cooling gas and the solid particulate material is achieved so that when the solid particulate material is discharged from the cooler tubes it will be cooled and when the cooling gas is supplied to the kiln, it will have been heated by the hot material to thereby provide preheated combustion air for the kiln.

As can be seen from FIG. 1, the material inlet and outlet are positioned so that the hot material is received from the kiln and the cool material is discharged from the cooler tubes 6 when the coolers are in the lower rotational positions.

As shown, the cooler 5 has its outlet uphill from its inlet. Therefore, each cooler tube or rotary heat exchanger 6 is provided with a helical conveyor generally indicated at 20 and including conveyor flights 21 for advancing material from the inlet 11 to the outlet 14. This conveyor is best shown in FIGS. 1 and 5 and extends along and is secured as by welding to the inside of the sidewall 8 of each cooler tube 6. As the cooler tube rotates and material tumbles within the cooler, the material is moved through the cooler by the conveyor 20. Each of the conveyor flights 21 have a central opening 22 therein to thereby define a longitudinal passage 23 through the conveyor 20 and the cooler which is sufficiently large to allow the volume of airflow from the inlet 15 to the outlet for gas of the cooler tube 6 required to cool the material and provide combustion air for the kiln. In some applications, the material outlet will be downhill from the material inlet and conveyor flights in such an application are not required since the material will move through the cooler by gravity.

At the material inlet end of the cooler tube 6 there may be provided spiral conveyor flights 25 and 26 which extend for a short distance along the length of the tube 6 to initially receive material from the inlet 11 and advance it to the conveyor 20. These flights 25 and 26 also serve to prevent material from returning to the kiln when the cooler tube rotates to its upper or top position by quickly moving the material away from the material inlet.

A plurality of heat exchange fins 30 are positioned in the cooler tube 6 between the flights 21 of the helical conveyor 20. These heat exchange fins are circumferentially spaced apart and secured as by welding to the inside of the sidewalls 8 of the tube 6. In the direction of rotation of the cooler tube 6, about the axis 3 of the kiln, the fins 30 include a leading surface 31 and a trailing surface 32. For clarity, the direction of the rotation of the kiln and hence each of the cooler tubes 6 is shown by the arrow in FIGS. 3 and 4. The fins 30 are positioned in the tube 6 so that an acute angle A is formed between the trailing surface 32 and the sidewall 8 of the tube 6. This is illustrated in FIG. 4 and a preferred angle of 45° is employed. This fin 30 thus also forms an acute angle with a radial line from the axis 7 of the cooler tube 6 to the base of the fin 30. It is to be understood, that the angle A can be altered depending upon the angle of repose of the material being cooled to insure complete contact between the heat exchange fin 30 and the material being cooled. The important feature is that the fins be swept back from the direction of rotation of the cooler tube 6.

The heat exchange fins 30 have a height H (FIG. 4) which is less than the normal depth D (FIG. 3) of material within the cooler tube 6 when measured at its deepest point so that at the material's deepest point, the heat exchange fin 30 is buried within material. As shown in FIG. 3, the conveyor 20 has a height measured from the inside of sidewall 8 to the edge of the opening 22 in the conveyor flight 21 which is greater than the normal depth of material in the cooler tube when such material is measured at its deepest point. It should be understood that there may be instances such as when a large quantity of material flushes through the kiln and cooler when the depth of material rises above the height of the conveyor flights 21 to flow directly through passage 23 and there may be instances such as in start-up when the depth D of material is below the height H of fins 30, but these instances are considered to be within the scope of the present invention. It should also be understood that in some applications, the material in a cooler tube 6 will be sloped from the inlet to the outlet so that the depth of material at the inlet end will be greater than the conveyor height.

The heat exchange fins are designed and positioned as shown so that as the tube 6 rotates, material is not lifted by the fins 30 directly into the air flow path through the passage 23. The fins 30 assist in cooling material by conducting at least some of the heat from the hot material to the outer shell 8 of the tube. The outer shell 8 is cooled by ambient air. Primarily, however, cooling of the material still takes place by the flow of cool air through the cooler tube 6 taking heat from the material and the heat exchange surfaces (fins 30 and conveyor flights 21), being heated and returned to the kiln as preheated combustion air. The cooling air flowing through the tubes 6 will serve to cool the fins 30 and spiral conveyor 20 when the fins move out of contact with the hot material on the cooler's rotational path around the axis 3 of the kiln. Although the material is not lifted by the fins 30, these fins will stir or mix the material with the cooler 6 to continuously expose new material to the surface S of material within the cooler. Although material is not lifted to fall through the air flow path through the cooler, as air flows through passage 23, it will circulate in the area between the flights 21 to cool the surface of the material as well as the exposed fins 30 and exposed portion of the helical conveyor 20, but this circulation of air will be at such a low velocity that material being cooled will not be entrained by the gas flow through the cooler.

As shown in FIGS. 1 and 5, the conveyor 21 terminates before the outlet 10, but the heat exchange fins 30 continue up to the outlet 10. In some cases it may be desirable to continue the conveyor to the outlet 10. In the embodiment shown, there are no heat exchange fins 30 before the first flight 21*a* of the conveyor 20. This arrangement is believed to be the most efficient in terms of heat exchange and conveyor efficiency, but it should be understood that in some applications it may be desirable to add fins 30 at this point.

Thus, the present invention improves heat exchange by substantially increasing contact between heat exchange surfaces including fins 30 and conveyor flights 21. Because of the design of the heat exchange fins, airborne material is not exposed to high velocity gas flow through the cooler. This reduces and in some cases will substantially eliminate the amount of dust within the cooler and the amount of dust or "product" returned to the kiln with the heated air used for combustion. A more efficient cooler is thus provided. Also, since dust is not returned to the kiln to be reheated, a more efficient kiln is provided.

From the foregoing, it should be apparent that the objects of this invention have been carried out. The fins 30 do not lift the material so there is a reduction or substantial elimination of airborne particles exposed to the high velocity gas flow through the cooler. As a result, the amount of dust blown back into the kiln 1 will be substantially reduced and may even be eliminated. Effective heat exchange is maintained because of the large surface area of heat exchange surfaces contacting the hot material. These heat exchange surfaces transfer the heat from the hot material to the gas flowing through the cooler tube and the thus heated air is returned to the kiln so that cooler and kiln efficiency are maintained.

Although the invention has been described as being applied to an attached tube cooler, it should be understood that the invention and particularly the heat exchange fins 30 can be applied to other rotary heat exchangers such as a rotary cooler, rotary preheater or attached tube preheater. It should also be understood that although the normal material depth in the heat exchanger has been shown as less than the height of the conveyor flights and the fins 30, the present invention should be construed as contemplating employing a conveyor flight having height less than the normal material depth and even a fin having a height greater than normal material depth.

The heat exchange fins 30 are shown as being spaced apart in the longitudinal direction by an amount sufficient to provide space for the helical conveyor. If the conveyor is not used, it may be desirable to sapce the heat exchange fins further apart in the longitudinal direction and place the fins so that the fins will be staggered within the cooler tube. Also, in some instances it may be desirable to make the fins out of a refractory material rather than metal.

It is intended that the foregoing be a description of a preferred embodiment, but that the invention be limited solely by that which is within the scope of the appended claims.

We claim:

1. A rotary heat exchange apparatus for achieving heat exchange between a gas and solid particulate material comprising:

a tubular vessel mounted for rotation about an axis and having peripheral walls, an inlet for solid particulate material, an outlet for solid particulate material, an inlet for gas and an outlet for gas;

a plurality of circumferentially spaced apart heat exchange fins mounted on the inside of the peripheral walls of said tubular vessel;

each of said heat exchange fins being mounted so that its trailing surface in the direction of rotation of the tubular vessel is at an acute angle to the peripheral wall of the tubular vessel;

the peripheral walls of said tubular vessel being substantially solid in the region of said heat exchange fins; and a helical conveyor mounted in the vessel with each flight of the helical conveyor having a central opening therethrough to define a gas flow passage through the heat exchange apparatus;

said heat exchange fins being positioned between at least some of the adjacent flights of the helical conveyor and having a height less than the radial height of the conveyor flights.

2. A rotary heat exchange apparatus according to claim 1 wherein said heat exchange fins have a height less than the normal depth of solid particulate material in the heat exchange apparatus measured at its deepest point.

3. A rotary heat exchange apparatus according to claim 2 wherein the height of the conveyor as measured from the peripheral walls of the tubular vessel to the edge of the opening through the conveyor flight which is greater than the normal depth of solid particulate material in the cooler tube.

4. A rotary heat exchange apparatus according to claim 2 wherein said tubular heat exchanger is mounted for rotation about an axis parallel to and off-set from its own axis.

5. A rotary heat exchange apparatus according to claim 4 wherein the inlet for solid particulate material and the outlet for gas are located at one end of the apparatus and the inlet for gas and the outlet for solid particulate material are located at the other end and the helical conveyor advances solid particulate material from the inlet for solid particulate material to the outlet for soild particulate material to thereby provide generally counter-current contact between gas and solid particulate material.

6. A rotary heat exchange apparatus for achieving heat exchange between a gas and solid particulate material comprising:

a tubular vessel mounted for rotation about an axis and having peripheral walls, an inlet and an outlet for solid particulate material whereby solid particulate material moves through the vessel from the inlet to the outlet for solid particulate material, an inlet for gas and an outlet for gas whereby gas flows through the vessel from the inlet to the outlet for gas; and a plurality of circumferentially spaced apart heat exchange fins mounted on the inside of the peripheral walls of the tubular vessel;

said peripheral walls of said tubular vessel being substantially solid in the region of said heat exchange fins around the circumference of the tubular vessel;

each of said heat exchange fins being mounted to form an acute angle between the trailing surface of the fin in the direction of rotation of the vessel and the peripheral wall of the vessel which permits contact of the solid particulate material with both the leading and trailing surfaces of the fin near the base of the fin while substantially preventing lifting of the solid particulate material into the gas which flows through the vessel.

7. A rotary heat exchange apparatus according to claim 6 wherein said fins have a height less than the normal depth of solid particulate material in said vessel when the depth of solid particulate material is measured at its deepest point so that the fins may be buried in the solid particulate material.

8. A rotary heat exchange apparatus according to claim 7 further comprising a helical conveyor mounted within said vessel for advancing solid particulate material from the inlet to the outlet for solid particulate material; each flight in the conveyor having a central opening therethrough to define a gas flow passage through the vessel; said heat exchange fins being positioned between at least some of the adjacent flights of the helical conveyor and have a height less than the radial height of the conveyor flights.

9. A rotary heat exchange apparatus according to claim 8 wherein said tubular heat exchanger is mounted for rotation about an axis parallel to and off-set from its own axis.

10. Apparatus for cooling solid particulate material thermally treated in a rotary kiln including a plurality of elongated cylinders adapted to be mounted on a rotary kiln for rotation with said rotary kiln about the axis of the kiln, each of said cylinders having an inlet at one end for receiving hot solid particulate material discharged from said kiln; an outlet at the other end for discharging cooled solid particulate material from the cylinder; an inlet as said other end of the cylinder for supplying cooling air to the cylinder whereby the cooling air passes through the cylinder, the hot solid particulate material is cooled and the cooling air is supplied to the kiln as preheated combustion air; apparatus for improving the heat exchange within the cylinder comprising;

a helical conveyor mounted within each of said cylinders for advancing material from the inlet for solid particulate material to the outlet for solid particulate material; and a plurality of circumferentially spaced apart fins mounted in each of said cylinders between at least some of the adjacent flights of said conveyor.

11. Apparatus for cooling solid particulate material according to claim 10 wherein each flight of the helical conveyor has a central opening therethrough and has a radial height from the inside surface of the cylinder to the central opening which is greater than the normal depth of solid particulate material in said cylinder, and the fins have a height less than the radial height of the conveyor flights.

12. Apparatus for cooling solid particulate material according to claim 11 wherein said fins are mounted in each of said cylinders at an angle to the radius to form an acute angle between the trailing surface of the fin in the direction of rotation of the cylinder and the cylinder wall.

13. Apparatus for cooling solid particulate material according to claim 12 wherein said fins have a height less than the normal depth of solid particulate material in said cylinder when the depth of solid particulate material is measured at its deepest point.

* * * * *

UNITED STATES PATENT OFFICE

CERTIFICATE OF CORRECTION

PATENT NO. : 4,131,418

DATED : December 26, 1978

INVENTOR(S) : Douglass J. Kramm, Thomas R. Lawall, Paul Talago

It is certified that error appears in the above-identified patent and that said Letters Patent are hereby corrected as shown below:

Column 7, line 6, "cooler tube" should be --vessel--.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*